United States Patent [19]

Clouser

[11] Patent Number: 4,461,385

[45] Date of Patent: Jul. 24, 1984

[54] LOCKING GUN RACKS

[76] Inventor: Roger A. Clouser, 1820 Ohio St., Lawrence, Kans. 66044

[21] Appl. No.: 246,623

[22] Filed: Mar. 23, 1981

[51] Int. Cl.[3] ..... A47F 7/00

[52] U.S. Cl. ..... 211/4; 211/64; 211/87; 70/58

[58] Field of Search ..... 211/4, 64, 87, 60 R; 70/58, 62

[56] References Cited

U.S. PATENT DOCUMENTS

| | | | |
|---|---|---|---|
| 1,951,255 | 3/1934 | Parker | 211/64 |
| 2,958,422 | 11/1960 | Caloiero et al. | 211/64 X |
| 3,031,069 | 4/1962 | Hirsch | 211/64 X |
| 4,118,902 | 10/1978 | Saxton | 70/58 X |
| 4,139,100 | 2/1979 | Reed | 211/64 X |
| 4,181,221 | 1/1980 | Tennant | 211/64 X |

*Primary Examiner*—Ramon S. Britts
*Assistant Examiner*—Robert W. Gibson, Jr.

[57] ABSTRACT

This invention discloses a high security, inexpensive and versatile manner of locking firearms by means of a cloth covered, hardened chain passing through the trigger guards or telescopic sight mounts, or by looping around the narrow pistol grip area of each gun. The hardened chain is then locked together in the center of the rack with a hardened padlock. The opposite ends of the chain are anchored by means of heavy lag bolts which reach the depth of the wall studs as the design of the locking racks provides for the anchoring members to be centered over the wall studs of the house. A unique covered chain slot design is disclosed which allows the chain to enter the anchor rails of the rack while still providing maximum protection from access to the head of the anchoring bolts. The rack designs disclosed allow for locking a plurality of long guns, a plurality of handguns, and a plurality of long guns and handguns simultaneously.

10 Claims, 10 Drawing Figures

LOCKING GUN RACKS

SUMMARY OF THE INVENTION

This invention relates to a locking system for securing firearms and other valuables and is visualized in a locking gun rack, which may be open or enclosed in a cabinet. The locking system utilizes case-hardened chain or cable covered with a protective non-marring covering, in this case, thick velour cloth, with said chain or cable anchored through the side rails of the gun rack and into the wall studs by means of heavy lag bolts. Racks with two anchoring points are constructed so that the anchoring points are 16", 24", 32", 48" etc. wide so that stud centers can be maintained. Racks with single point anchors need only have the main anchor rail centered on a stud. The anchoring lag bolts pass through the last chain link, while said chain passes through a machined slot in the side of the hardwood side rail. The head of the bolt is protected from removal by the insertion of a glued hardwood plug into the recessed cavity above the bolt head. With one end of each chain firmly bolted into the wall studs, and said bolts extending the full depth allowed by the size of the wall studs, the free ends of the chain or cable are passed through the trigger guards or telescopic sight mounts, or simply looped around the narrow grip area of each gun, and are then locked in the center of the rack with a case-hardened padlock. The anchoring members of this rack are made from thick hardwood, thus allowing ample protection from easy access to the bolt head. Additional mounting lag bolts are utilized in the gun rack, aside from the ones securing the chain, to give the rack even greater protection from being pryed off the wall.

On racks holding long guns vertically, such as the floor model, an optional handgun accessory tray is provided. This tray, utilizing a unique system of adjustable V-blocks to firmly hold handguns in place while the chain is pulled through their trigger guards, allows handguns to be supported at a level such that the same chain that locks the long guns can be used to lock the handguns. This handgun accessory tray, also made of wood, has a removable attaching plate and can be mounted on either or both sides of the vertical floor rack. Thus, the utility of the vertical floor rack is increased considerably by its ability to lock up handguns, shotguns and rifles at the same time.

It is the object of this invention to:

1. Provide a locking system for gun racks, as well as other practical applications, wherein the rack to which the firearms are secured is in itself heavily bolted to the wall studs of a building by way of self-tapping lag bolts penetrating the depth of the studs;

2. Provide a locking system that will insure that guns will remain locked to the rack even if the wall studs are destroyed and the rack is removed from the wall;

3. Provide that the mounting bolts of the rack are inaccessible without specialized tools and/or an inordinate amount of time, and that the chain ends are both securely fastened to the anchor rails and also inaccessible;

4. Allow a plurality of both long guns and handguns of different sizes, styles and calibers to be locked up separately or simultaneously;

5. Allow a locking rack design that derives its strength from the use of hardened steel in exposed areas, while taking advantage of the inherent strength found in the structure of the house. Since the rigidity of the rack relies on the wall studs, it is not necessary to increase manufacturing costs by providing reinforced joints or abnormally expensive construction materials. In addition, the rack can be shipped flat and disassembled to further maintain low costs;

6. Allow a locking rack which will not only provide security great enough to deter the non-professional intruder, but will also allow the open display of firearms in places where it is desirable;

7. Allow a locking rack design with high security and low cost, so that the utility of the rack will be realized by the actual manufacturing and offering of said rack to the public.

DESCRIPTION OF PRIOR ART

Although patents issued for locking gun racks date back to the last century, it is notable that the prior art generally falls into two categories:

1. Those designs that are easily foiled by thieves; and
2. Those too expensive to sell commercially.

In the first category, there is an abundance. The inventions of Caloiero 1960 (U.S. Pat. No. 2,946,452), Diebold 1954 (U.S. Pat. No. 2,667,274), Levy 1965 (U.S. Pat. No. 3,180,494), Schaefer 1970 (U.S. Pat. No. 3,507,398), Capolupo 1980 (U.S. Pat. No. 4,198,026), Reed 1979 (U.S. Pat. No. 4,139,100), Walters 1975 (U.S. Pat. No. 3,917,071), Caloiero 1958 (U.S. Pat. No. 2,958,422), Pritz 1977 (U.S. Pat. No. 4,018,339), and Worswick 1980 (U.S. Pat. No. 4,182,453) suffer from the drawback that these sometimes rather ingeneous locking mechanisms can easily be negated by simply picking up the unsecured rack and carrying it away, by unscrewing the exposed mounting screws with a screwdriver, or by prying the rack off the small mounting screws with a small crowbar. Since it is these two devices, a large screwdriver or a small crowbar, that are commonly carried by quick entrance/quick exit thieves, the security element of these racks is limited. Even more limited are the designs of Levy 1956 (U.S. Pat. No. 2,752,046), Levy 1952 (U.S. Pat. No. 2,623,639), Levy 1965 (U.S. Pat. No. 3,180,494), Levy 1952 (U.S. Pat. No. 2,616,566), Bowen 1966 (U.S. Pat. No. 3,291,317), Caloiero 1960 (U.S. Pat. No. 2,946,452) and Caloiero 1960 (U.S. Pat. No. 2,958,423) since they have no provision for anchoring the rack; simply prying open a drawer at the bottom is all that is necessary to negate the locking system.

Of the inventions cited, those that do have rack anchoring provisions utilize small slot head screws for such mounting. These screws cannot provide adequate resistance to prying force from a small crowbar since they cannot penetrate the mounting medium sufficiently. Moreover the designs of these gun racks do not provide for centering the mounting screws on the strong parts of the wall, the wall stud. To do so they would have to be specifically constructed to allow the mounting bolts to be spaced at the stud centers. Furthermore, these racks could not accommodate 1. The bulk of heavy bolts;
2. The mandatory frame size increases that would be necessary to match the increased bolt strength; and
3. A system to protect the bolt heads from easy access.

All of these deficiencies are corrected in my invention.

It should be mentioned that Parker 1933 (U.S. Pat. No. 1,951,255) utilized a chain drawn through the trigger guards of rifles as part of his locking system. While his chain was uncovered and conducive to scratching the firearms, the most important defect of his design was the total omission of a way to connect the chain ends to the frames on each end. The drawing of his invention does not demonstrate how he proposed to do this, and in fact, his description confirms that he did not have a solution to this problem. In line 76 of his description, Parker states "A chain 24 is *securely attached* to one side 11 and is threaded through the trigger guards of the rifles and locked by means of a padlock to the other side". (emphasis added). It should be stressed that an inexpensive means of effectively anchoring the chain end is paramount to the success of this locking system, and it is totally lacking in Parker's design. In addition, there are no anchoring provisions to prevent his entire rack from being picked up and carried away. It is certainly little security to an owner if in his absence, anyone can appropriate the entire rack and its contents to his detriment.

Hence, there are six important ways in which my invention improves the rather incomplete idea designed by Parker:

1. The chain and padlock are both hardened steel to prevent cutting with a hacksaw and covered with thick velour cloth to prevent marring of the guns;

2. The covered chain-slot principle of anchoring the chain end on a heavy bolt inside thick hardwood side rails with a hardwood plug protecting access to said bolts provides a combination of high security and low cost in a utilitarian design available to the average firearm owner;

3. The anchoring of the chain ends to the wall studs by heavy lag bolts which penetrate the extent of the wall studs protects the rack from removal from the wall by prying;

4. The provision exists for locking handguns only, long guns only, or a combination of the two simultaneously;

5. The provision exists to lock a single long gun or a plurality of long guns on a finished or unfinished wall, such that the firearms can be displayed, in cases where it is desirable, with the minimum visual obstruction;

6. Because the chain is sheathed in a protective cloth covering, it is possible without damaging the firearms, to utilize a chain of longer length and tightly wrap it (i.e., make a loop) around the pistol grip area of a rifle or shotgun. This provides an excellent way of securing those few long guns that have easily removable trigger guards, since the wider buttstock and forearm areas would prevent the gun from being removed from the chain loop.

DESCRIPTION OF THE PREFERRED EMBODIMENTS

Figure 1:
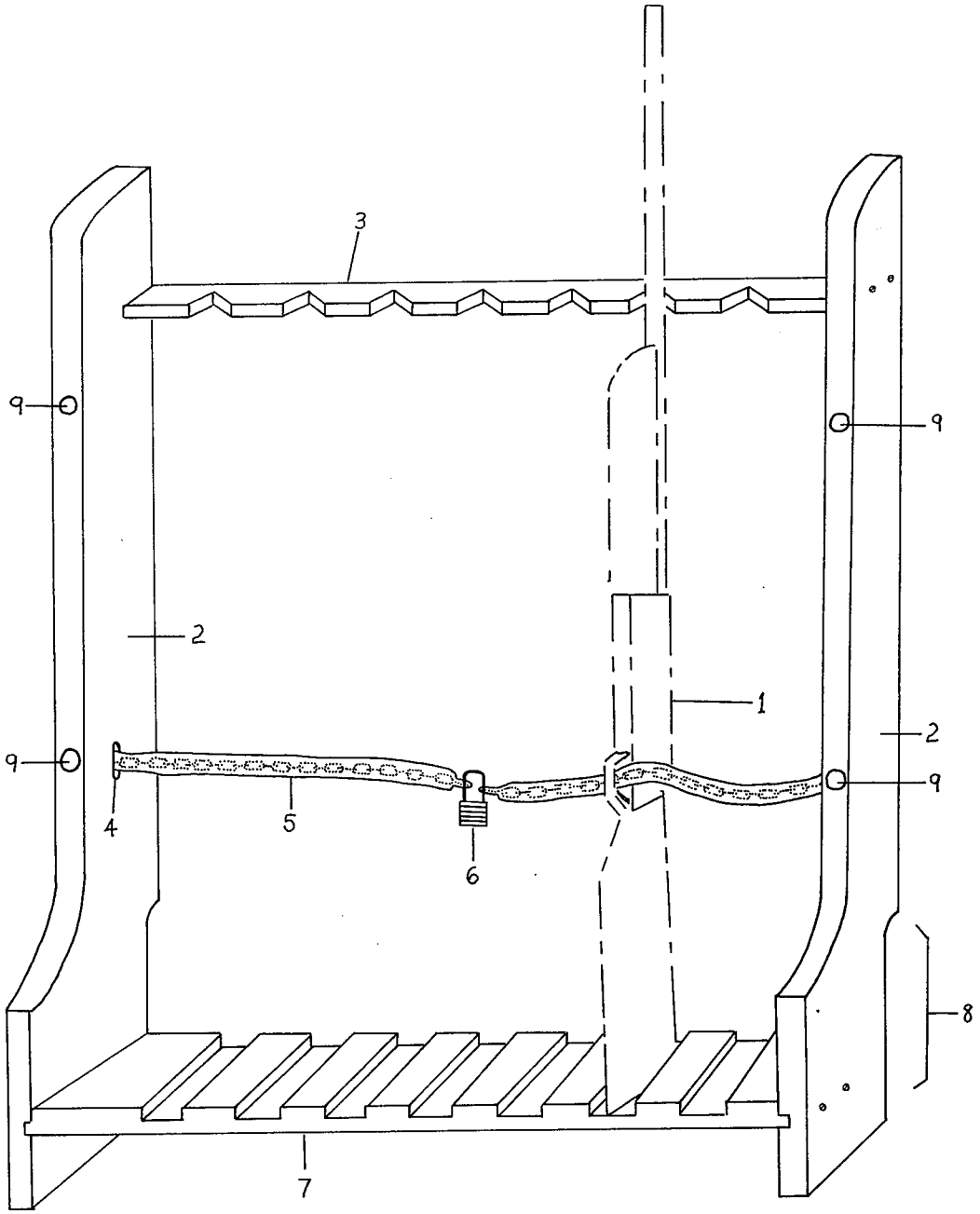
FIG. 1 illustrates the vertical floor rack and the manner in which a rifle or shotgun is locked.

In specific reference to the drawings, FIG. 1 shows the vertical floor rack wherein 1 is a rifle or shotgun with it's buttstock resting on the bottom rail 7 which has deep grooves in it to prevent the firearm from moving or twisting out of place when the velour covered hardened chain 5 is pulled through the trigger guard. The bottom rail 7 is made of wood and is machined to fit the slot of the side rail 2 to which it is fastened with two screws on each side. The bottom rail 7 is also placed at an angle from horizontal, being higher in the front of the rack, to allow the barrels of the guns to lean back on the top rail 3 with sufficient force that the barrels remain in the grooves of the top rails while the chain 5 is pulled through the trigger guards. The stabilizing effects of the tilted and channeled bottom rail 7 allow the guns to be firmly but gently held in their place by gravity during all locking and unlocking activities. The slots in the top rail 3 are designed to receive all single and double barrel guns presently made. The top rail 3 is also made of wood, and connects to the side rails 2 by means of two wood screws on each end, entering from the side rails. The gun contact points of the top rail 3 and the bottom rail 7 are covered with felt to prevent marring. The side rails 2 are made of thick hardwood and have a baseboard recess 8 to allow the rack to be mounted firmly to the wall without interference from the baseboard. The floor rack can also be mounted high on a wall, preferably over a desk or workbench. Each side rail 2 on the floor rack is drilled for two heavy bolts, with a plug 9 covering each bolt head. The top bolts serve to anchor the rack to the wall, and the bottom bolts anchor the rack and the chain ends. The cloth covered case-hardened chain or cable 5 enters the side rail 2 through the machined chain slot 4. The chain 5 is connected in the center of the rack by a case-hardened padlock 6.

Figure 2:
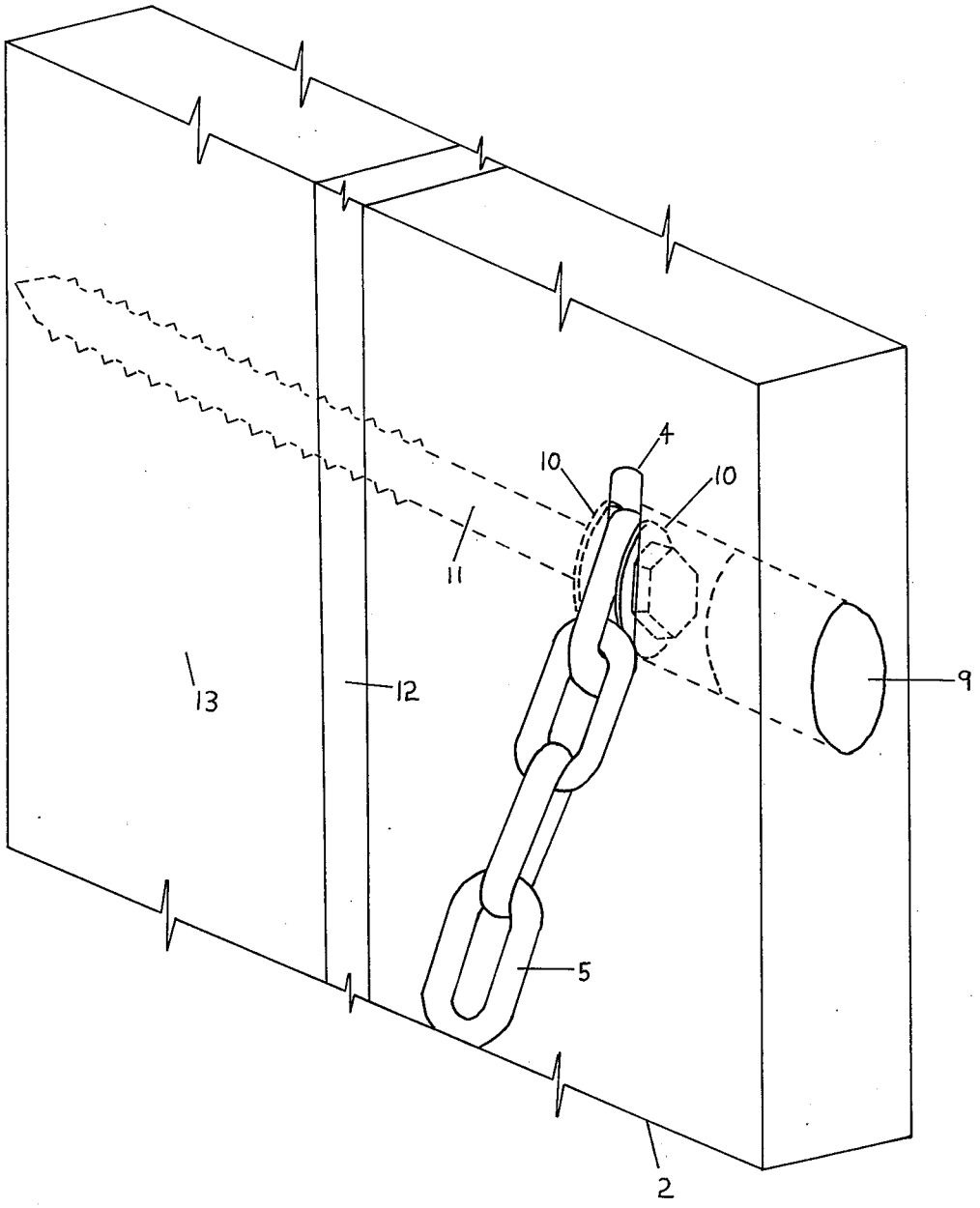
FIG. 2 shows a three-dimensional drawing of the covered chain slot principle of anchoring the chain ends into the wall stud.

FIG. 2 illustrates the chain anchoring system utilized in the various different styles of gun racks shown. A heavy lag bolt 11 is recessed in the side rail 2 and covered with a hardwood plug 9 forced in and/or glued in over it. The hardened chain 5 enters the machined chain slot 4 in the side rail 2, and a flat washer 10 is inserted on each side of the chain link to increase the surface area of the link to both the bolt head and the wood side rail. The bolt length is such that it penetrates the sheetrock or plaster 12 and the full depth of the wall stud 13.

Figure 3:
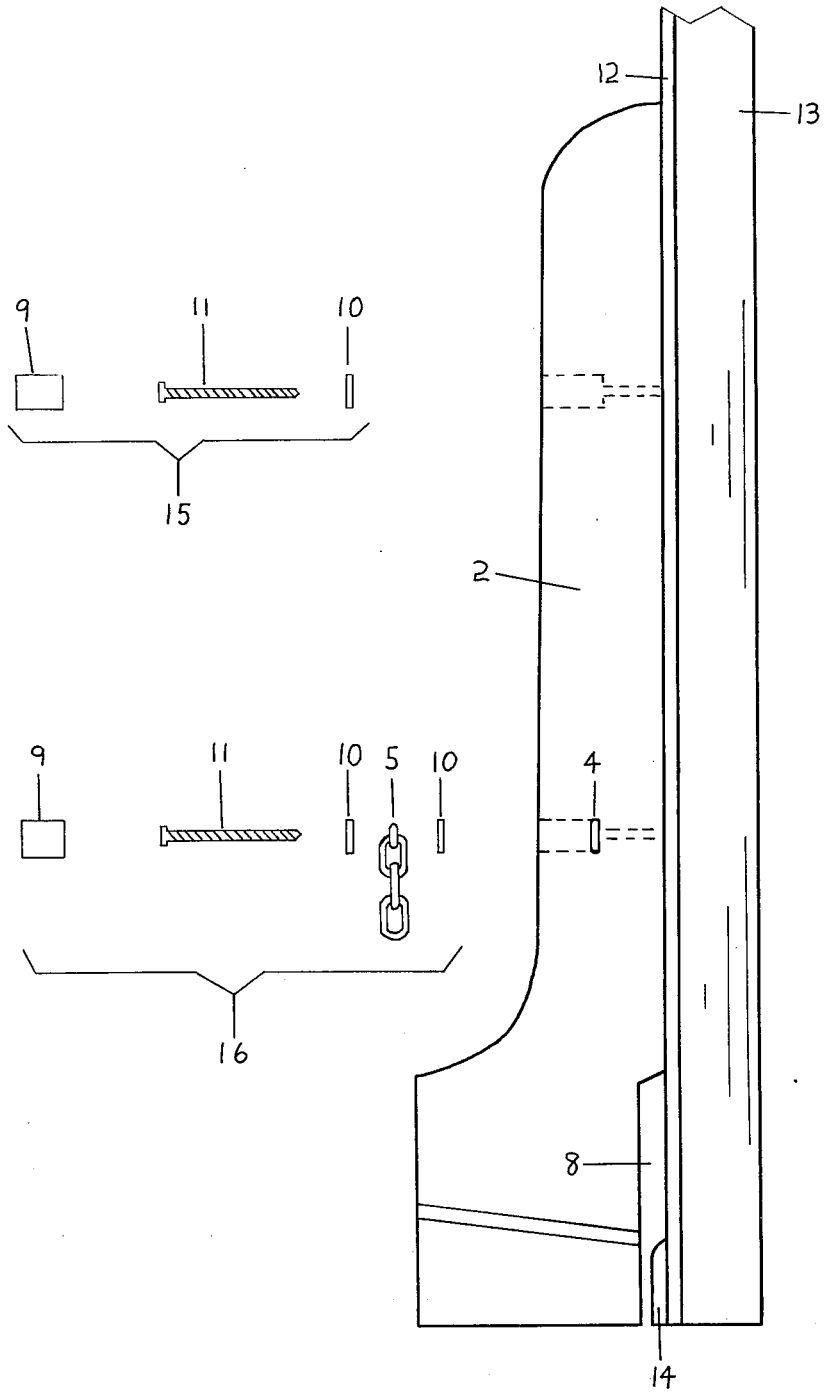
FIG. 3 is a side view of the vertical floor rack side rail showing the sequence of parts which constitute the anchoring hardware.

FIG. 3 is a side view of the exploded locking and anchoring components of the vertical floor rack. The side rail 2 is firmly mounted against the sheetrock or plaster 12 of the wall, with provision of the baseboard recess 8, which allows room for the baseboard 14. There are two anchor groups per side rail, with the upper one 15 consisting of a hardwood plug 9, heavy lag bolt 11, and one flat washer 10. The lower anchor group 16 consists of a hardwood plug 9, heavy lag bolt 11, and two flat washers 10 on either side of the case-hardened chain 5. This lower anchor group 16 is easily installed by inserting the chain end through the chain slot 4, placing a washer on both sides of the chain and simply threading the bolt through the chain link. The bolt is tightened with a ratchet wrench with a short extension, and the hardwood plug 9 is then glued in over the bolt head.

Figure 4:
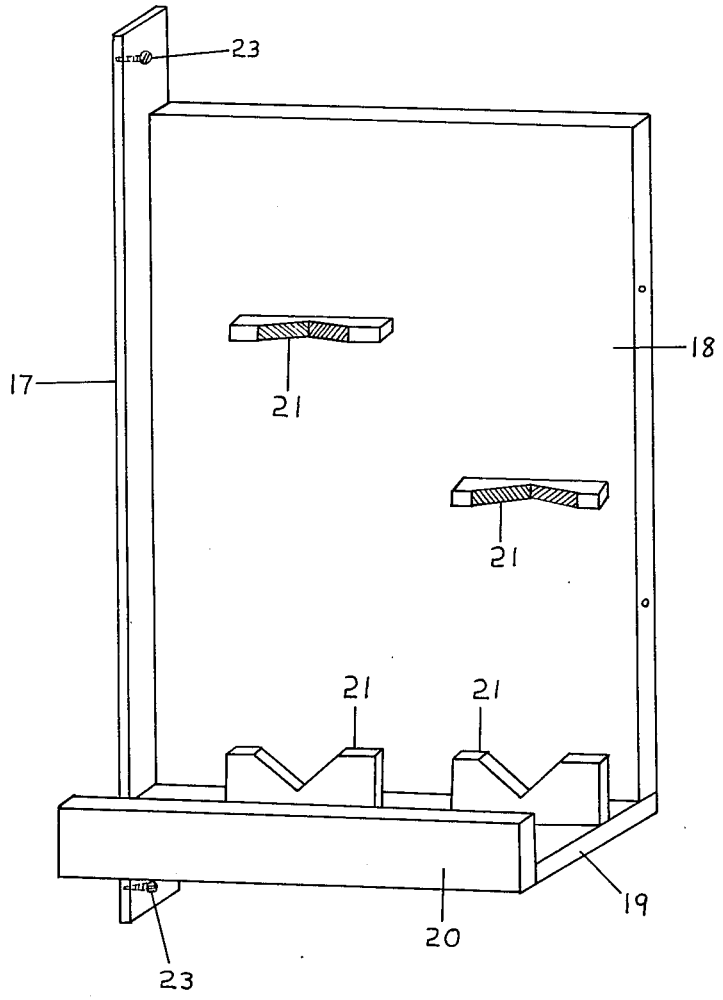
FIG. 4 illustrates the handgun accessory tray, an add-on unit for the vertical floor model, which allows handguns to be locked into the same rack.
Figure 5:
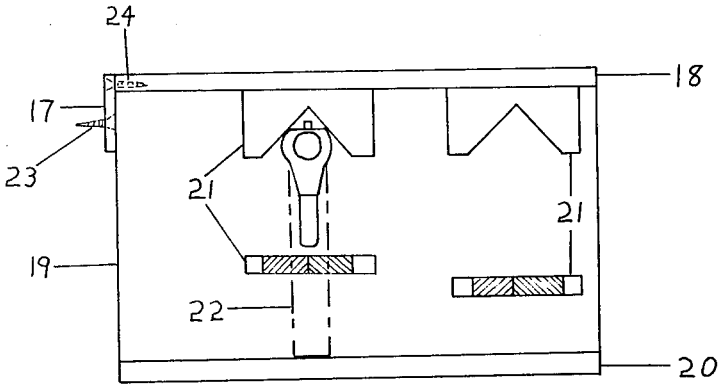
FIG. 5 is a top view of the handgun accessory tray.
Figure 6:
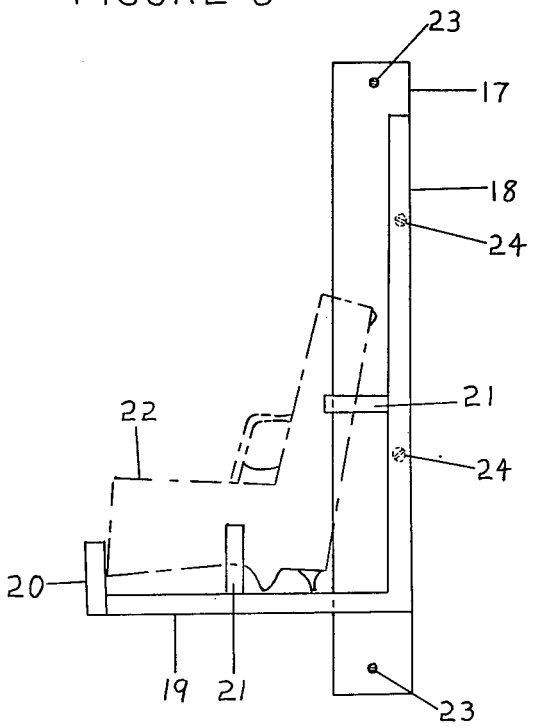
FIG. 6 is a side view of the handgun accessory tray.
Figure 7:
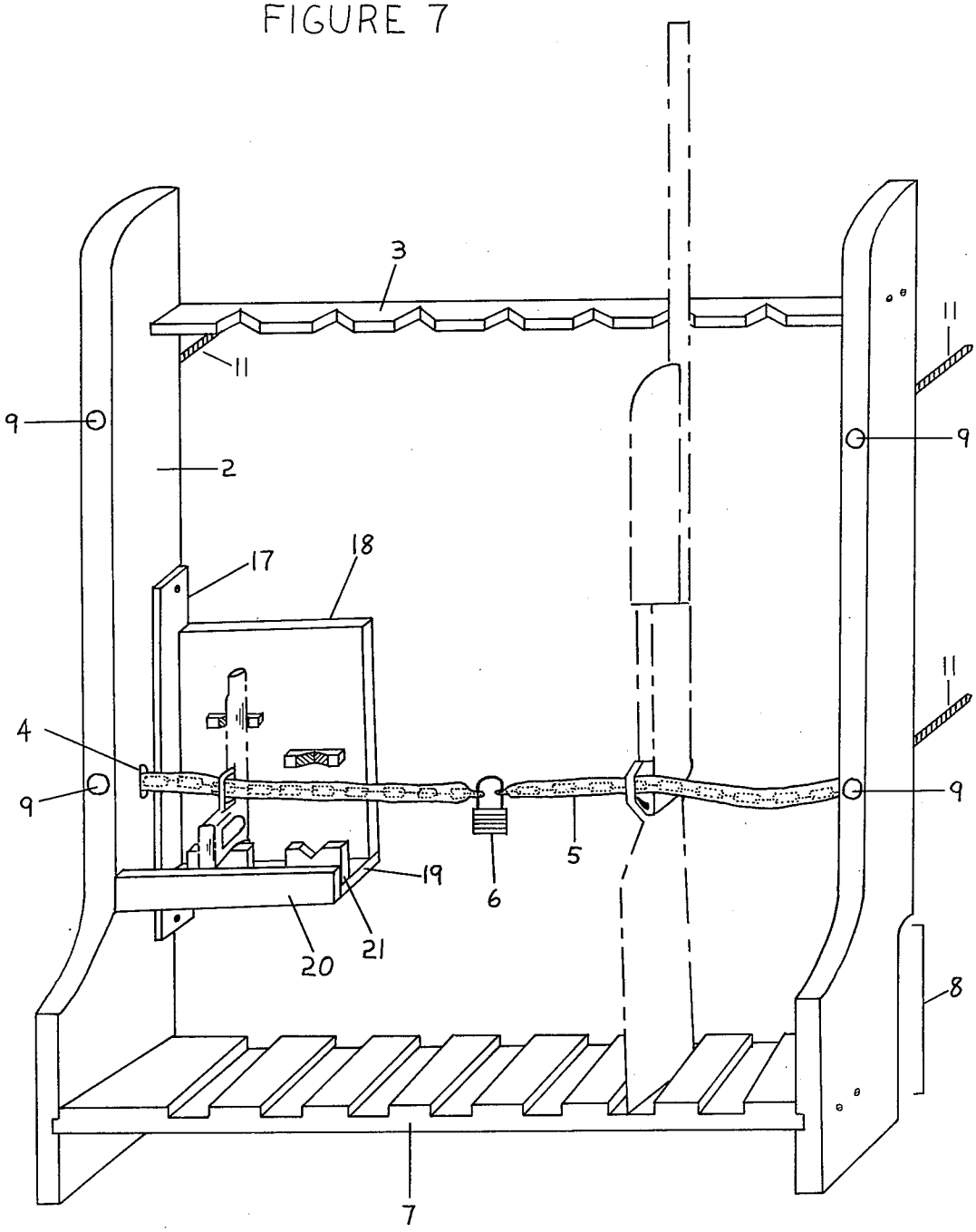
FIG. 7 shows the manner in which the handgun rack is mounted on the vertical floor rack.

FIGS. 4, 5 and 6 illustrate the handgun accessory tray, an add-on unit for the vertical floor rack wherein handguns are supported at the proper height to allow the chain to pass through their trigger guards. The handgun accessory tray is made of wood and is attached to the vertical floor rack by two screws 24 passing through the attaching plate 17 into the side rail 2 of the vertical floor rack. The attaching plate 17 has four screw holes, two for screws 23 to the side rail 2 and two for the screws 24 to connect to the rear plate 18 of the handgun tray. The rear plate 18 is drilled to accept the two screws from the attaching plate 17 on either the right or left side, so that the handgun rack may be placed on the right, left or both side rails 2 of the vertical floor rack. The bottom plate 19 of the handgun rack attaches to the front lip 20 and the rear plate 18 by means of screws from the bottom, a glued rabbet joint, or a combination thereof. There are four V-blocks 21 that are supplied with the handgun rack, said V-blocks 21 being made of wood and covered with felt in the grooves. These V-blocks are separate pieces and are supplied unattached to the handgun rack. Referring now to FIGS. 5 and 6, after handgun tray is attached by the two screws 23 to the side rail 2 of the vertical floor rack, the handgun is placed in an upright position, trigger guard facing out, on the bottom plate 19 of the handgun tray. One V-block 21 is placed under the grip area of the handgun 22 and another under the barrel area, with the butt end of the grip resting on the front lip 20 of the handgun tray. This three-point platform system of holding the handgun in a firm position prevents the gun from moving while the locking chain 5 is passed through its trigger guard, and allows a custom fitting of a wide variety of handguns by simply sliding the V-blocks 21 until a snug fit is established. Common household glue is used to fasten the V-blocks 21 in place, under the weight of the handgun, once the proper fit is established for a particular gun. An illustration of the handgun accessory tray in use on a vertical floor rack is shown in FIG. 7.

Figure 8:
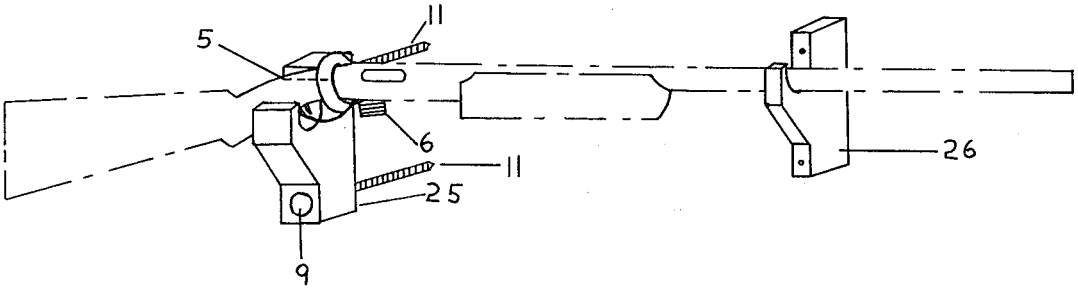
FIG. 8 illustrates the one-gun horizontal wall display rack, which employs the covered chain slot principle and hardened covered chain as a locking device.
Figure 9:
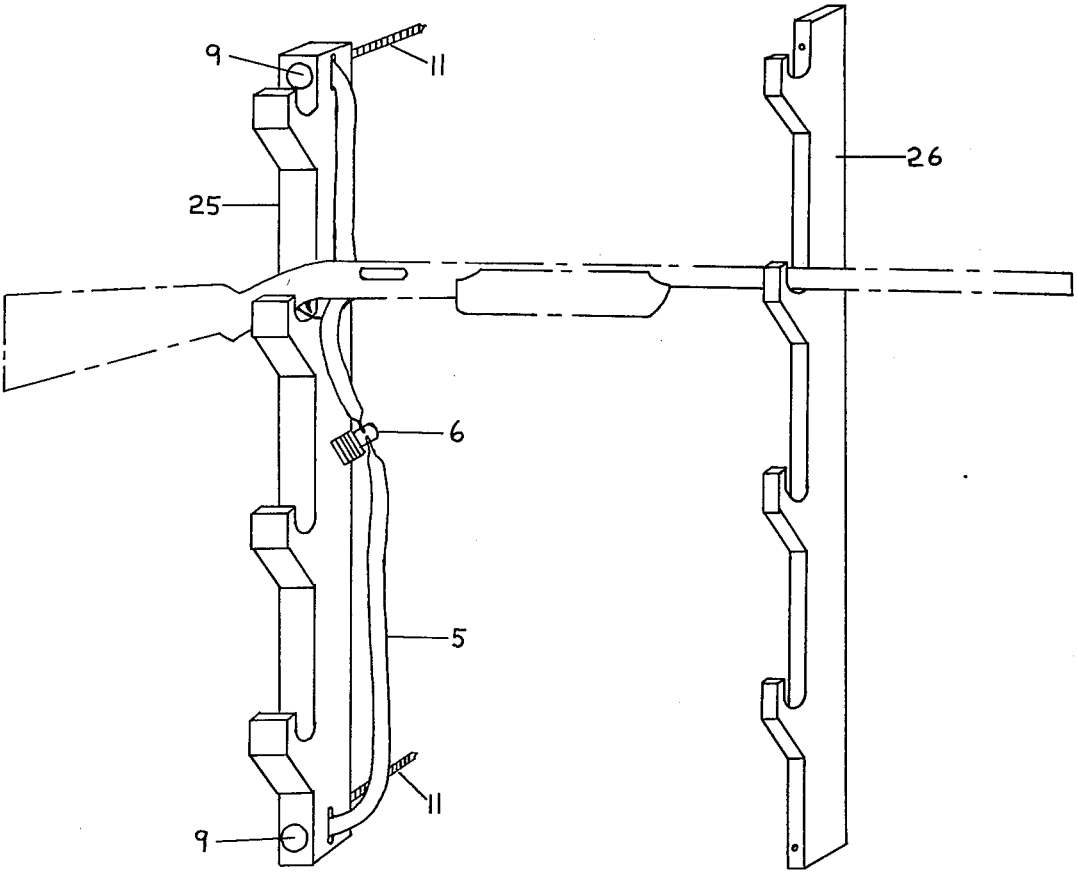
FIG. 9 illustrates a four-gun horizontal wall display rack similar to FIG. 8.

FIGS. 8 and 9 demonstrate the horizontal wall display racks for long guns which utilize the same locking principle shown in the vertical floor rack. FIG. 8 is a single anchor rack, with the loose chain end either locked directly to the trigger guard or preferably the chain is inserted through the trigger guard and wrapped tightly around the receiver area and locked back on itself on the rear side as illustrated. The anchor rail 25 is bolted with two heavy lag bolts to the wall stud. The barrel support rail 26 need only be attached to the sheetrock or plaster with sheet metal screws and hollow wall anchors. FIG. 9 illustrates a four-place horizontal rack with two anchor points, both bolted into the same wall stud. The wall display racks of FIGS. 8 and 9 allow a great amount of security and a minimum amount of visual obstruction for long guns that must be displayed.

Figure 10:
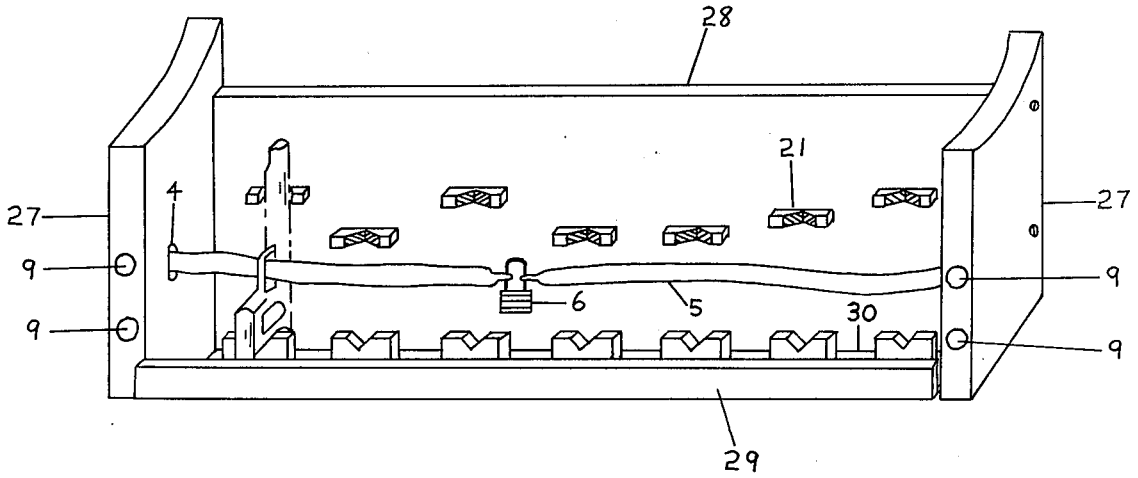
FIG. 10 illustrates a locking handgun rack utilizing the same locking principle as the vertical rack in FIG. 1 and the same V-block platform system of holding handguns as shown in the handgun accessory tray of FIGS. 4, 5 and 6.

FIG. 10 illustrates a locking handgun rack wherein a plurality of handguns are locked. The locking system is identical as that shown in FIGS. 1 and 2, with the anchor rails 27 centered on the wall studs. A front lip 29, bottom plate 30, back plate 28 and V-blocks 21 make up an adjustable system of firmly holding the handguns in place. This is the same system as shown in the handgun accessory tray of FIGS. 4, 5 and 6.

The invention is hereby claimed as follows:

1. A locking gun rack comprising:

a wall-mountable frame having means for receiving stock and barrel portions of guns therein;

slot means disposed in said frame and a passageway which extends through said frame and intersects said slot means;

at least one elongated, flexible gun retaining means removably fitted through or wrapped around narrow portions of guns contained in said rack, having at least one end thereof fitted with a loop means received into said slot means and another end thereof fitted with a locking means which permits removal or securing of said gun retaining means to said guns;

bolt means mounted through said passageway and said loop means and extending into at least one interior stud of an adjacent wall for securing said frame to said wall; and plug means fitted in said frame for rendering the heads of said bolt means inaccessible when said frame is secured to said wall.

2. The gun rack according to claim 1, wherein said flexible gun retaining means comprises a length of chain covered with a non-marring material and said loop means includes the end link of said chain.

3. The gun rack according to claim 1 wherein said passageway includes a counter-bored portion having a diameter larger than the head of said bolt means, and said plug means securely fills this counter-bored portion when said bolt means is extended into said interior wall studs.

4. The gun rack according to claim 1, wherein said frame includes top, bottom, and side rails, and wherein said side rails include said slot means, said top rail includes V-shaped barrel receiving grooves, and said bottom rail includes stock receiving slots.

5. The gun rack according to claim 1, further including an accessory tray attached to said frame for locking handguns.

6. The gun rack according to claim 5, wherein said accessory tray includes V-shaped grooved portions for receiving the barrels and hand grips of handguns therein and a vertically extending front lip for retaining said handguns on said V-shaped grooved portions.

7. The gun rack according to claim 5, wherein said accessory tray is mounted such that handguns may be secured simultaneously with long barrel guns by the same flexible gun retaining means.

8. A secure, wall-mounted display rack for firearms comprising:

side rails adapted to support firearms in a generally horizontal position and having a slot therein and a passageway therethrough which intersects said slot;

an elongated, flexible firearm retaining means adapted to be removably fitted through apertures in said firearms or wrapped about constrictions of said firearms, having at least one end thereof fitted with a loop means adapted to be received in said slot, and further including locking means which permits removal from or securing of said firearms to said side rails;

bolt means adapted to secure at least one of said side rails to the interior studs of a wall and at least one of which has a diameter corresponding to said side rail passageway diameter and being less than the interior diameter of said loop means; and wherein said side rail passageways are aligned with said interior wall studs, said loop means is inserted into said slot, said bolt means having a diameter corresponding to said side rail passageway diameter and being less than the interior diameter of said loop means is extended through said loop means and said passageway and into at least one of said interior wall studs so as to secure said firearm retaining means to said wall stud, and the head of this bolt means is covered with a plug means which renders said head inaccessible.

9. A wall-mounted locking means for firearms and other valuables:

cloth-covered, case hardened chain and padlock means for being strong through fixed openings or wrapped about constrictions of said firearms or other valuables;

top and bottom horizontal wooden rails wherein said top rail includes v-shaped grooves of sufficient width to retain a variety of barrels of said firearms therein, said bottom rail includes deep channels vertically aligned with said v-shaped grooves and being of a configuration to tightly hold the butt end of the stocks of said firearms, and said bottom rail is tilted at an angle such that its front edge is vertically higher than its back edge;

a plurality of thick, hardwood side rails each of which being connected to an end portion of said top and bottom rails, said side rails each having cutout portions corresponding to the configuration of wall baseboards so as to permit said side rails to rest flush against a wall and being of sufficient thickness so as to contain therein relatively thick, hardwood anchoring means, said side rails each having a machined slot therein and a passageway therethrough which intersects said machined slot and is counter-bored at the front end thereof so as to enlarge said passageway;

heavy, self-tapping bolts, having a head of smaller diameter than the diameter of said counter-bored portion of said passageway, adapted to extend through the non-counter-bored portion of said passageway and the end link of said chain and into the interior support studs of said wall;

wherein said anchoring means are aligned with said interior support studs, said end links of said chain means are inserted into said machined slots and retained therein by said bolts as said bolts extend into said support studs, and that portion of said counter-bored passageway which is not occupied by said bolt head is securely filled by a hardwood plug; and a removable accessory tray attached to one of said side rails for supporting and locking handguns wherein said handguns are supported in an upright vertical position with their trigger guards facing forward and maintained within said locking means at a height sufficient to permit them to be simultaneously locked with and by the same means as long barrel firearms, said tray including a plurality of adjustable blocks having v-shaped grooves therein, a vertically extending front lip, and a removable attaching plate adapted to permit mounting of said accessory tray to either of said side rails.

10. The locking means according to claim 9, wherein said accessory tray is adapted to permit locking of a plurality of handguns.

* * * * *